US008069936B2

(12) United States Patent
Scott et al.

(10) Patent No.: US 8,069,936 B2
(45) Date of Patent: Dec. 6, 2011

(54) ENCAPSULATED DIAMOND PARTICLES, MATERIALS AND IMPREGNATED DIAMOND EARTH-BORING BITS INCLUDING SUCH PARTICLES, AND METHODS OF FORMING SUCH PARTICLES, MATERIALS, AND BITS

(75) Inventors: Danny E. Scott, Montgomery, TX (US); Wesley D. Fuller, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 22 days.

(21) Appl. No.: 12/274,600

(22) Filed: Nov. 20, 2008

(65) Prior Publication Data

US 2010/0122853 A1 May 20, 2010

Related U.S. Application Data

(63) Continuation-in-part of application No. 11/678,304, filed on Feb. 23, 2007, now Pat. No. 7,810,588.

(51) Int. Cl.
*E21B 10/36* (2006.01)
*E21B 10/46* (2006.01)

(52) U.S. Cl. ..... 175/434; 175/374; 51/295

(58) Field of Classification Search ..... 175/425, 175/434, 374; 51/295; 428/403
See application file for complete search history.

(56) References Cited

U.S. PATENT DOCUMENTS 3,316,073 A 4/1967 Kelso
3,650,714 A * 3/1972 Farkas ..... 51/295
3,663,191 A * 5/1972 Kroder ..... 428/643
4,770,907 A 9/1988 Kimura
5,143,523 A 9/1992 Matarrese
5,151,107 A 9/1992 Cho et al.
5,405,573 A 4/1995 Clark et al.
6,102,140 A 8/2000 Boyce et al.
(Continued)

FOREIGN PATENT DOCUMENTS

EP 0012631 A1 6/1980
(Continued)

OTHER PUBLICATIONS

Written Opinion of the International Searching Authority for International Application No. PCT/US2009/063813 dated May 20, 2010, 4 pages.

(Continued)

*Primary Examiner* — William P Neuder
*Assistant Examiner* — Cathleen Hutchins
(74) *Attorney, Agent, or Firm* — TraskBritt

(57) ABSTRACT

Earth-boring tools and components thereof include a particle-matrix composite material having encapsulated diamond particles embedded within a matrix material. Diamonds in the particles comprise less than about 25% by volume of the composite material, the matrix material comprises less than about 50% by volume of the composite material, and encapsulant material surrounding the diamonds at least substantially comprises a remainder of the volume of the composite material. Methods of forming at least a portion of an earth-boring tool include embedding encapsulated diamond particles in a volume of matrix material to form a particle-matrix composite material. The composite material is formed in such a manner as to cause diamonds to comprise less than about 25% of the composite material, the matrix material to comprise less than about 50% of the composite material, and encapsulant material surrounding the diamonds to at least substantially comprise a remainder of the composite material.

33 Claims, 3 Drawing Sheets

U.S. PATENT DOCUMENTS

| | | | | |
|---|---|---|---|---|
| 6,170,583 | B1 | 1/2001 | Boyce | |
| 6,238,280 | B1 | 5/2001 | Ritt et al. | |
| 6,394,202 | B2 | 5/2002 | Truax et al. | |
| 7,350,599 | B2 | 4/2008 | Lockwood et al. | |
| 2007/0102198 | A1 | 5/2007 | Oxford et al. | |
| 2007/0102199 | A1 | 5/2007 | Smith et al. | |
| 2007/0214727 | A1 * | 9/2007 | Egan et al. | 51/295 |
| 2008/0017421 | A1 * | 1/2008 | Lockwood | 175/434 |
| 2008/0202821 | A1 | 8/2008 | McClain et al. | |
| 2008/0282618 | A1 | 11/2008 | Lockwood | |

FOREIGN PATENT DOCUMENTS

| | | |
|---|---|---|
| GB | 1014295 | 12/1965 |

OTHER PUBLICATIONS

International Search Report for International Application No. PCT/US2009/063813 dated May 20, 2010, 3 pages.

* cited by examiner

ENCAPSULATED DIAMOND PARTICLES, MATERIALS AND IMPREGNATED DIAMOND EARTH-BORING BITS INCLUDING SUCH PARTICLES, AND METHODS OF FORMING SUCH PARTICLES, MATERIALS, AND BITS

CROSS-REFERENCE TO RELATED APPLICATION

This application is a continuation-in-part of prior U.S. patent application Ser. No. 11/678,304, which was filed Feb. 23, 2007, and issued as U.S. Pat. No. 7,810,588 B2 on Oct. 12, 2010, the disclosure of which is incorporated herein in its entirety by this reference.

TECHNICAL FIELD

Embodiments of the present invention generally relate to encapsulated diamond particles, materials including such encapsulated diamond particles, and earth-boring tools including such encapsulated diamond particles or materials. Embodiments of the present invention also relate to methods of manufacturing such particles, materials, and earth-boring tools.

BACKGROUND

Impregnated diamond earth-boring bits may be used for drilling hard or abrasive rock formations such as sandstones. Typically, an impregnated diamond bit has a solid head or crown that is cast in a mold. The crown is attached to a steel shank that has a threaded end that may be used to attach the crown and steel shank to a drill string. The crown may have a variety of configurations and generally includes a cutting face comprising a plurality of cutting structures, which may comprise at least one of cutting segments, posts, and blades. The posts and blades may be integrally formed with the crown in the mold, or they may be separately formed and attached to the crown. Channels separate the posts and blades to allow drilling fluid to flow over the face of the bit.

Impregnated diamond bits may be formed such that the cutting face of the drill bit (including the posts and blades) comprises a particle-matrix composite material that includes diamond particles dispersed throughout a matrix material. The matrix material itself may comprise a particle-matrix composite material, such as particles of tungsten carbide, dispersed throughout a metal matrix material, such as a copper-based alloy.

While drilling with an impregnated diamond bit, the matrix material surrounding the diamond particles wears at a faster rate than do the diamond particles. As the matrix material surrounding the diamonds on the surface of the bit wears away, the exposure of the diamonds at the surface gradually increases until the diamonds eventually fall away. As some diamonds are falling away, others that were previously buried become exposed, such that fresh sharp diamonds are continuously being exposed and used to cut the earth formation being drilled.

Typically, an impregnated diamond bit is formed by mixing and distributing diamond particles and other hard particles, such as, particles of tungsten carbide, in a mold cavity having a shape corresponding to the bit to be formed. The diamond particles and hard particles are then infiltrated with a molten metal matrix material such as, for example, a copper-based metal alloy. After infiltration, the molten metal matrix material is allowed to cool and solidify. The resulting impregnated diamond bit may then be removed from the mold. Alternatively, a mixture of diamond particles, hard particles, and powder matrix material may be pressed into the a desired shape to form a green bit body, and the green bit body may then be sintered one or more times to form an impregnated diamond bit having a desired final density.

During such fabrication processes, the diamond particles may not be uniformly dispersed throughout the matrix material. The diamond particles have a tendency to agglomerate together, leaving a greater density of diamonds in some regions of the bit relative to other regions of the bit. This may result in two or more diamond particles lying in contact with one another rather than being uniformly dispersed, as desired. These diamond-to-diamond contacts may substantially weaken the impregnated diamond bit and may result in uneven drilling and chipping or fracture of the blade or post on the bit.

BRIEF SUMMARY

In some embodiments, the present invention includes components of earth-boring tools that comprise a particle-matrix composite material having a metal matrix material and a plurality of encapsulated diamond particles embedded within the metal matrix material. The diamonds of the encapsulated diamond particles comprise less than about 25% by volume of the particle-matrix composite material, and the metal matrix material comprises less than about 50% by volume of the particle-matrix composite material. One or more layers of encapsulant material surrounding the diamonds may at least substantially comprise a remainder of the volume of the particle-matrix composite material.

In additional embodiments, the present invention includes earth-boring tools for drilling subterranean formations that include a body having a formation-engaging surface and at least one cutting structure. At least a portion of the body comprising the formation-engaging surface includes a particle-matrix composite material having a metal matrix material and a plurality of encapsulated diamond particles embedded within the metal matrix material. The diamonds of the encapsulated diamond particles comprise less than about 25% by volume of the particle-matrix composite material, and the metal matrix material comprises less than about 50% by volume of the particle-matrix composite material. One or more layers of encapsulant material surrounding the diamonds may at least substantially comprise a remainder of the volume of the particle-matrix composite material.

In further embodiments, the present invention includes methods of forming at least a portion of an earth-boring tool. The methods include encapsulating diamonds having a selected average particle size with one or more layers of encapsulant material to form a plurality of encapsulated diamond particles having a selected average encapsulant thickness. The plurality of encapsulated diamond particles is embedded in a selected volume of metal matrix material to form a particle-matrix composite material. The average particle size of the diamonds, the average encapsulant thickness of the plurality of encapsulated diamond particles, and the selected volume of metal matrix material are selected to cause the diamonds to comprise less than about 25% by volume of the particle-matrix composite material, the metal matrix material to comprise less than about 50% of the volume of the particle-matrix composite material, and the one or more layers of encapsulant material to at least substantially comprise the remainder of the volume of the particle-matrix composite material.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the description of embodiments of the invention when read in conjunction with the accompanying drawings, in which:

DETAILED DESCRIPTION OF THE INVENTION

Some of the illustrations presented herein are not meant to be actual views of any particular material, device, or system, but are merely idealized representations which are employed to describe the present invention. Additionally, elements common between figures may retain the same numerical designation.

Embodiments of the present invention include impregnated diamond drill bits and components of such drill bits (such as cutting segments, blades, or posts) that comprise particle-matrix composite materials that include encapsulated diamond particles. In some embodiments, the particle-matrix composite materials within at least a region of the crown of the impregnated diamond drill bits, or at least a region of the components of such drill bits, have a diamond concentration that is at least partially a function of, or controlled by, a thickness of the encapsulation layer or layers surrounding the individual diamond particles.

Figure 1:
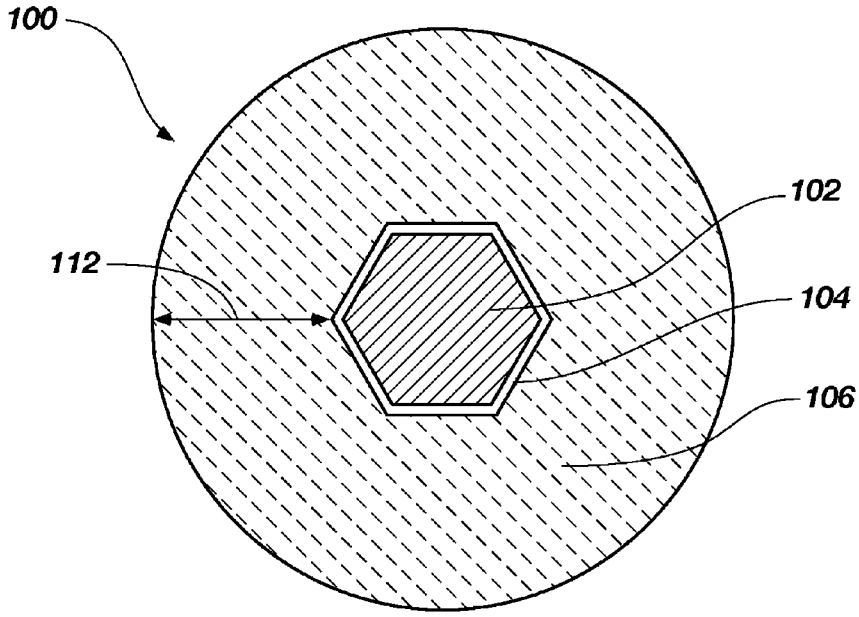
FIG. 1 is a simplified illustration of an enlarged cross-sectional view of one encapsulated diamond particle of the present invention.

FIG. 1 is a simplified illustration of an enlarged cross-sectional view of one encapsulated diamond particle 100, a plurality of which may be used to form embodiments of the present invention. The encapsulated diamond particle 100 shown in FIG. 1 includes a diamond 102 encapsulated within an encapsulant material 106. The diamond 102 also may be coated with a relatively thinner intermediate encapsulant material 104, which may be disposed intermediately between the diamond 102 and the encapsulant material 106, as shown in FIG. 1. The diamond 102, encapsulant material 106, and the optional intermediate encapsulant material 104 are described in further detail below.

The encapsulated diamond particles 100 may comprise generally rough, non-rounded (e.g., polyhedron-shaped) particles. In other embodiments, the encapsulated diamond particles 100 may comprise generally smooth, rounded particles. As discussed in further detail below, the encapsulated diamond particles 100 may be used to form particle-matrix composite materials. Particle-matrix composite materials that include generally smooth, round particles may exhibit higher fracture toughness relative to particle-matrix composite materials that include rough, non-rounded particles, as relatively sharper points and edges on particles may promote the formation of cracks in the resulting particle-matrix composite material. The smooth, rounded particles may also be more tightly and uniformly dispersed throughout the particle-matrix composite material.

The diamond 102 in the encapsulated diamond particle 100 may comprise a natural or synthetic single diamond crystal, which may have a cubic, octahedral, or cuboctahedral shape with at least substantially planar facets or sides. When using a plurality of encapsulated diamond particles 100 to form embodiments of the invention, the diamonds 102 may exhibit a Gaussian or a log-normal particle size distribution. In some embodiments, the diamonds 12 may have an at least substantially uniform average crystal size. In additional embodiments, the diamonds 102 may have a multi-modal particle size distribution (e.g., bi-modal, tri-modal, penta-modal, etc.). By way of example and not limitation, the diamonds 102 may comprise −20/+60 ASTM mesh size diamonds. As used herein, the phrase "−20/+60 ASTM mesh size diamonds" means diamonds that pass through an ASTM No. 20 U.S.A. standard testing sieve, but not through an ASTM No. 60 U.S.A. standard testing sieve, as defined in ASTM Specification E11-04 which is entitled *Standard Specification for Wire Cloth and Sieves for Testing Purposes*. Such diamonds 102 may have an average particle size (i.e., an average diameter) of between about 255 microns and about 850 microns. As additional non-limiting embodiments, the diamonds 102 may comprise at least one plurality of diamonds 102 of following particle sizes: −30/+40 ASTM mesh (or approximately 660 stones per carat of diamond, one carat being equal to 200 milligrams); −25/+35 ASTM mesh (or approximately 420 stones per carat); −20/+25 ASTM mesh (or approximately 210 stones per carat); −18/+20 ASTM mesh (or approximately 150 stones per carat); and −50/+60 ASTM mesh.

The intermediate encapsulant material 104 may comprise a metal such as, for example, tungsten or titanium. In additional embodiments, the intermediate encapsulant material 104 may comprise a metal carbide such as tungsten carbide or titanium carbide. The intermediate encapsulant material 104 may reduce or prevent degradation of, or damage to, the diamond 102 during any subsequent high temperature processes to which the diamonds 102 or the encapsulated diamond particles 100 may be exposed. The intermediate encapsulant material 104 may also prevent carbon atoms in the diamond 102 from chemically reacting in any adverse manner with the encapsulant material 106. The intermediate encapsulant material 104 may also help the encapsulant material 106 adhere to the diamond 102 when the encapsulant material 106 is applied thereto, as described below.

The intermediate encapsulant material 104 may be relatively thin in comparison to the average diameter of the diamond 102. By way of example and not limitation, the intermediate encapsulant material 104 may have an average thickness of less than about 5% of the average diameter of the diamonds 102. More particularly, the intermediate encapsulant material 104 may have an average thickness of between about 0.5% and about 3% of the average diameter of the diamonds 102. As a non-limiting example, the intermediate encapsulant material 104 may have an average thickness of between about one micron (1 μm) and about ten microns (10 μm).

The encapsulant material 106 may comprise a carbide material such as, for example, tungsten carbide, titanium carbide, tanatalum carbide, or silicon carbide. In some embodiments, the encapsulant material may comprise monotungsten carbide, ditungsten carbide, or a eutectic composition of monotungsten carbide and ditungsten carbide. The encapsulant material 106 may at least substantially completely encapsulate or surround each diamond 102. Prior to using the encapsulated diamond particles 100 to form a particle-matrix composite material, as described in further detail below, the encapsulant material 106 may comprise a sintered carbide material (e.g., sintered tungsten carbide) or a powdered carbide material. Examples of methods that may be used to form encapsulated diamond particles having layers comprising powdered encapsulant material thereon are disclosed in, for example, U.S. patent application Ser. No. 11/678,304, which was filed Feb. 23, 2007, now U.S. Pat. No. 7,810,588, issued Oct. 12, 2010 and entitled "*Multi-Layer Encapsulation Of Diamond Grit For Use In Earth-Boring Bits*," the disclosure of which is incorporated herein in its entirety by this reference.

The encapsulant material 106 may be relatively thick in comparison to the average diameter of the diamond 102. By way of example and not limitation, the encapsulant material 106 may have an average thickness of greater than about 100% of the average diameter of the diamonds 102. In some embodiments, the encapsulant material 106 may have an average thickness of between about 80% and about 120% of the average diameter of the diamonds 102. As a non-limiting example, the encapsulant material 106 may have an average thickness of between about 355 μm and about 1,020 μm.

Examples of processes that may be used to form encapsulated diamond particles 100 are briefly described below.

Diamonds 102 are commercially available in a wide range of particles sizes and particle size distributions. If the encapsulated diamond particles 100 are to include an intermediate encapsulant material 104, the diamonds 102 may be coated with an intermediate encapsulant material 104. The intermediate encapsulant material 104 may be formed on the diamonds 102 using, for example, a chemical vapor deposition (CVD) process or a physical vapor deposition (PVD) process. In other embodiments, the intermediate encapsulant material 104 may be formed on the diamond 102 in a fluidized bed using processes such as, for example, those disclosed in U.S. Pat. No. 6,238,280 to Ritt et al., the entire disclosure of which is incorporated herein in its entirety by this reference.

The encapsulant layer 106 may be formed on the diamonds 102 using, for example, a tumble mill process in which the diamonds 102 are milled in a tumble mill together with a powder mixture comprising the material or materials that will form the encapsulant layer 106. By way of example and not limitation, the diamonds 102 may be ball milled with a powder mixture comprising a powdered carbide material, such as, for example, powdered tungsten carbide, as well as a powdered metal matrix material, such as, for example, powdered cobalt material. Optionally, the powder mixture may further include additives such as, for example, organic binders, plasticizers, and lubricants. The powder particles in the powder mixture may be at least substantially smaller than the diamonds 102 so that the powder mixture will adhere to, and accumulate on, the diamonds 102 as the diamonds 102 are milled with the powder mixture. The diamonds 102 may be rolled or mixed in the powder mixture so that the powder mixture first adheres to the surface of the diamonds 102, and also adheres to itself so that the total thickness 112 of the powder material on the diamonds 102 increases to a thickness corresponding to several layers of the particles in the powder mixture.

After the powder mixture has reached the desired thickness 112 on the diamonds 102, the powder material may then be sintered to densify and bond together the powder material on the diamonds 102. Sintering the powder material may help to ensure the integrity the encapsulant layer 106 when the encapsulated diamond particles 100 are used to form a particle-matrix composite material 110. The sintering process may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering process may include subliquidus phase sintering. In other words, the sintering processes may be conducted at temperatures proximate to but below the liquidus line of the phase diagram for the powdered metal matrix material (e.g., powdered cobalt) in the powder mixture.

Figure 2:
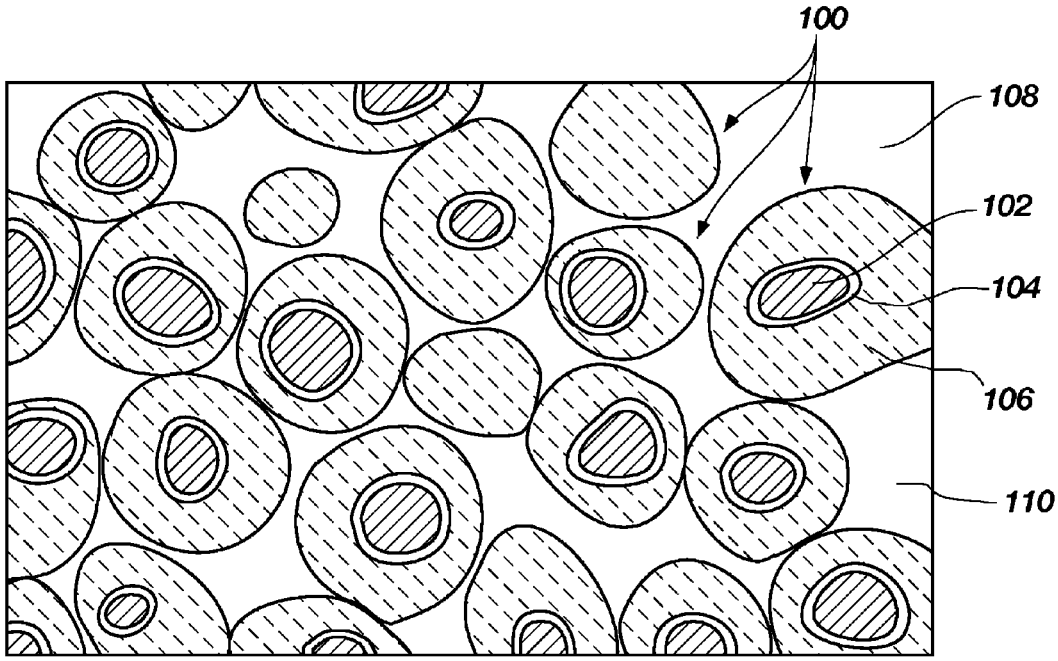
FIG. 2 is a simplified illustration showing one example of how the microstructure of an embodiment of a particle-matrix composite material of the present invention, which includes encapsulated diamond particles, may appear under magnification.

Encapsulated diamond particles 100, such as that shown in FIG. 1, may be used to form particle-matrix composite materials in embodiments of impregnated diamond drill bits and components of such drill bits of the present invention. FIG. 2 illustrates one example of how the microstructure of an embodiment of a particle-matrix composite material 110, which includes a plurality of encapsulated diamond particles 100, may appear under magnification. The encapsulated diamond particles 100 are dispersed throughout and embedded within a metal matrix material 108. The encapsulant material 106 and the optional intermediate encapsulant material 104 surrounding the diamonds 102 may cause the diamonds 102 to be at least substantially uniformly distributed throughout the particle-matrix composite material 110.

In some embodiments, the metal matrix material 108 may comprise a commercially pure metal such as copper, cobalt, iron, or nickel. In additional embodiments, the metal matrix material 108 may comprise a metal alloy material such as a copper-based alloy, a cobalt-based alloy, an iron based alloy, a nickel-based alloy, or a titanium-based alloy.

As previously mentioned herein, in some embodiments of the present invention, the particle-matrix composite material may have a diamond concentration that is at least partially a function of, or controlled by, a thickness of the encapsulation layer or layers surrounding the individual diamond particles. In other words, the particle-matrix composite material 110 shown in FIG. 2 may have a diamond concentration that is at least partially a function of the thickness of the encapsulant material 106, or, if present, the combined thicknesses of the encapsulant material 106 and the intermediate encapsulant material 104. As used herein, the term "average encapsulant thickness" means the average total thickness of any and all layers of encapsulant material provided on encapsulated diamond particles 100.

In some embodiments, the particle-matrix composite material 110 may be primarily made of encapsulated diamond particles 100 and metal matrix material 108, and may be at least substantially void of any additional hard particles. In other words, the particle-matrix composite material 110 may be at least substantially comprised of encapsulated diamond particles 100 and metal matrix material 108. In such embodiments, the encapsulated diamond particles 100 may have an average encapsulant thickness of at least about 50% of the average diameter of the diamonds 102. More particularly, the encapsulated diamond particles 100 may have an average encapsulant thickness of at least about 100% of the average diameter of the diamonds 102. In some embodiments, the encapsulated diamond particles 100 may have an average encapsulant thickness of between about 80% and about 120% of the average diameter of the diamonds 102.

In other embodiments, however, the particle-matrix composite material 110 may comprise additional hard particles, such as particles of tungsten carbide, wherein the volumetric concentration of such additional hard particles is less than the volumetric concentration of the pores or spaces between the encapsulated diamond particles 100. In such embodiments, any additional hard particles may comprise less than about 15% by volume of the particle-matrix composite material 110, and such hard particles may have an average diameter that is less than about 10% of an average diameter of the encapsulated hard particles 100. By using a relatively small volume of additional hard particles, and using additional hard particles that are relatively smaller than the encapsulated diamond particles 100, such additional hard particles may not result in any significant decrease in the average diamond density of the diamonds 102 in the particle-matrix composite material 110.

As used herein, the term "diamond concentration" refers to the carat weight of diamond per unit volume of particle-matrix composite material 110. In some embodiments of the present invention, the particle-matrix composite material 110 may have an average diamond concentration of less than about 4.4 carats per cubic centimeter ($cm^3$). More particularly, the particle-matrix composite material 110 may have an average diamond concentration of between about 3.5 carats per cubic centimeter ($cm^3$) and about 4.4 carats per cubic centimeter ($cm^3$). In terms of volume percentages, the diamonds 102 may comprise less than about 25% by volume of the particle-matrix composite material 110, the metal matrix material 108 may comprise less than about 50% by volume of the particle-matrix composite material 110, and the one or more encapsulant layers may at least substantially comprise the remainder of the volume of the particle-matrix composite material 110. More particularly, the diamonds 102 may comprise between about 20% and about 25% by volume of the particle-matrix composite material 110, the metal matrix material 108 may comprise less than about 40% by volume of the particle-matrix composite material 110, and the one or more encapsulant layers may at least substantially comprise the remainder of the volume of the particle-matrix composite material 110. In embodiments in which the encapsulated diamond particles 100 have a multi-modal particle size distribution, and the encapsulated diamond particles 100 corresponding to at least one mode are small enough to at least substantially fit within interstitial spaces between the encapsulated diamond particles 100 corresponding to at least one other mode, the diamonds 102 may comprise between about 20% and about 25% by volume of the particle-matrix composite material 110, the metal matrix material 108 may comprise between about 10% and about 25% by volume of the particle-matrix composite material 110, and the one or more encapsulant layers may at least substantially comprise the remainder of the volume of the particle-matrix composite material 110.

Figure 3:
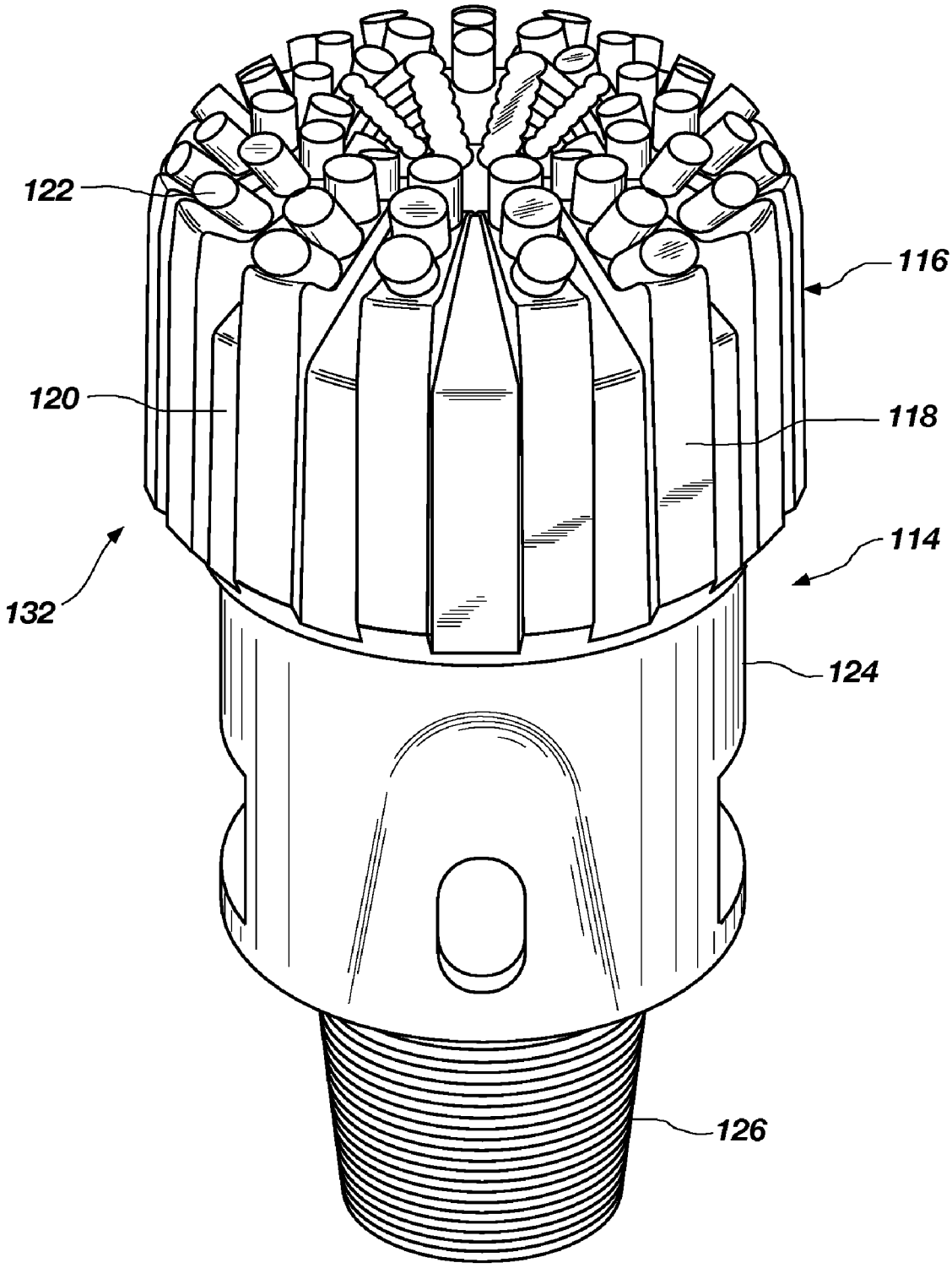
FIG. 3 is a perspective view of an embodiment of an earth-boring drill bit of the present invention that includes a crown region comprising an embodiment of a particle-matrix composite material of the present invention.

As previously mentioned, embodiments of encapsulated diamond particles 100 of the present invention may be used to form a body or a component of an earth-boring tool, such as blades, posts, or another portion of a body of a diamond impregnated earth-boring rotary drill bit. A non-limiting embodiment of a diamond impregnated drill bit of the present invention is shown in FIG. 3. The drill bit 114 includes a crown region 116 comprising a particle-matrix composite material that may include a plurality of encapsulated diamond particles 100 dispersed throughout a metal matrix material 108. The crown region 116 may have a variety of configurations. The crown region 116 may include a plurality of blades 118 formed therein. The blades 118 may be separated from each other by fluid channels 120. A plurality of segments or posts 122 may extend from the blades 118, as shown in FIG. 3. In additional embodiments, however, the blades 118 may be generally smooth and continuous and free of segments or posts 122. By way of example and not limitation, the drill bit 114 may also include a metal shank 124 with one end attached to the crown region 116 and the opposing end having threads 126 for attachment to a drill string (not shown).

Figure 4:
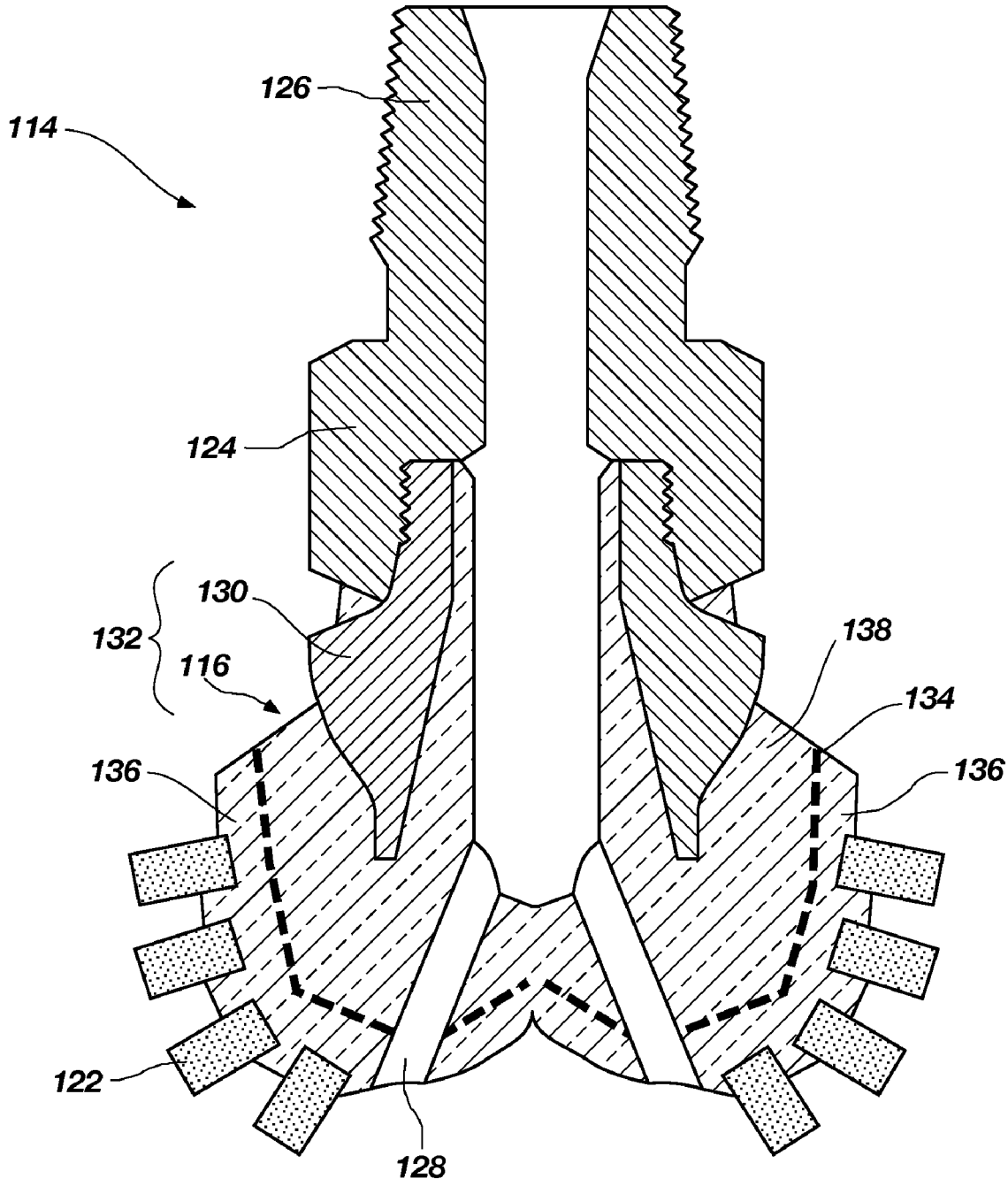
FIG. 4 is a longitudinal cross-sectional view of the earth-boring drill bit of FIG. 3.

FIG. 4 is a longitudinal cross-sectional view of the diamond impregnated drill bit of FIG. 3. As shown in FIG. 4, the bit body 132 of the drill bit 114 may include a metal blank 130 that is attached to the crown region 116 and used to attach the crown region 116 to the metal shank 124, as known in the art. In other embodiments, however, the bit body 132 may not include a metal blank 130, and the shank 124 may be attached directly to the crown region 116. In yet further embodiments, the bit body 132 may include a so-called "extension" or "cross-over" (which may be attached to the crown region 116 after formation of the crown region 116 as opposed to during formation of the crown region 116) instead of a metal blank 130. The metal blank 130 may comprise a machinable metal or metal alloy such as, for example, a steel alloy, and may be configured for securing the crown region 116 of the bit body 132 to the metal shank 124. The drill bit 114 may also include internal fluid passageways 128 within the drill bit 114.

As previously discussed, in some embodiments, the entire crown region 116 may be at least predominantly comprised of a particle-matrix composite material 110 that includes a plurality of encapsulated diamond particles 100. In additional embodiments, the encapsulated diamond particles 100 may only be distributed throughout the outer portion or cutting face 136 of the crown region 116, which includes the blades 118 and segments or posts 122. The cutting face 136 of the crown region 116 maybe illustrated as the area on the outside of dashed line 134 in FIG. 4. The interior portion 138 of the crown region 116 may comprise a particle-matrix composite material including hard particles such as, for example, tungsten carbide, embedded within a matrix material such as, for example, a copper-based, nickel-based, cobalt-based, or iron-based metal alloy. The interior portion 138 may be at least substantially void of encapsulated diamond particles 100. In yet further embodiments, only the blades 118 and the segments or posts 122 may comprise the encapsulated diamond particles 100. Placing the encapsulated diamond particles 100 only in the cutting face 136 of the crown region 116 may be more cost-effective than using encapsulated diamond particles 100 throughout the entire crown region 116 of the drill bit 114.

As previously discussed herein, the crown region 116 comprising the particle-matrix composite material 110, which includes the encapsulated diamond particles 100, may be at least substantially void of additional hard particles (e.g., additional tungsten carbide particles). The encapsulated diamond particles 100 may be at least substantially uniformly distributed throughout the cutting face 136 of the crown region 116. As the drill bit 100 drills into a rock formation, the metal matrix material 108 may wear the fastest, followed by the one or more layers of encapsulant material (encapsulant material 106 and intermediate encapsulant material 104), and finally the diamond 102. This wearing order may result in the diamond 102 protruding the farthest at the face of crown region 116, followed by the encapsulant materials, and then the metal matrix material 108.

Bodies of earth-boring tools that embody the present invention may be formed by various techniques. For example, bit bodies of earth-boring rotary drill bits, such as the bit body 132 shown in FIGS. 3 and 4, may be formed using, for example, so-called "infiltration" casting techniques. In such embodiments, a mold (not shown) may be provided that includes a mold cavity having a size and shape corresponding to the size and shape of the bit body 132. In other words, the surfaces of the mold within the mold cavity may have a shape corresponding to the shape of the crown region 116 including recesses in the shape of the blades 118 and the segments or posts 122. The mold may be formed from, for example, graphite or any other high-temperature refractory material, such as a ceramic material. The mold cavity of the mold may be machined using a multi-axis (e.g., 5, 6, or 7-axis) machining system. Fine features may be added to the cavity of the mold using hand-held tools. Additional clay work also may be required to obtain the desired configuration of some features of the bit body 132. Where necessary, preform elements or displacements (which may comprise ceramic components, graphite components, or resin-coated sand compact components) may be positioned within the mold cavity and used to define the internal fluid passageways 128 and external topographic features of bit body 132.

After forming the mold, a powder comprising a plurality of encapsulated diamond particles 100, as previously described herein, may be provided within the mold cavity to form a powder bed having a shape that corresponds to the bit body 132. In some embodiments of the present invention, no additional hard particles (other than the encapsulated diamond particles 100) may be provided within the mold cavity. In additional embodiments, the encapsulated diamond particles 100 may only be packed into the regions of the mold cavity corresponding to the cutting face 136 and cutting structures (e.g., blades and/or posts) of the crown region 116, and the remainder of the mold cavity may be packed with a plurality of hard particles such as, for example, tungsten carbide particles. While additional hard particles may be added to the interior portion 138 of the crown region 116, no additional loose hard particles may be added to the portion of the mold cavity corresponding to the cutting face 136 of the crown region 116. Optionally, a metal blank 130 may be at least partially embedded within the powder bed such that at least one surface of the metal blank 130 is exposed to allow subsequent machining of the surface of the metal blank 130 (if necessary or desirable) and subsequent attachment thereof to the metal shank 124.

The concentration of diamonds 102 in any given portion of the crown region 116 may be at least primarily a function of the thickness 112 of the encapsulant material 106. Once the encapsulated diamond particles 100 are placed in the mold, molten metal matrix material 108 then may be allowed or caused to infiltrate the spaces between the encapsulated diamond particles 100 within the mold cavity. Particles or chunks of matrix material may be placed on top of the powder bed (which comprises the encapsulated diamond particles 100) within the mold cavity. The mold may then be placed into a furnace to melt the particles or chunks of matrix material. As the particles or chunks of matrix material melt, the molten metal matrix material 108 may flow into and infiltrate the spaces between the particles in the powder bed within the mold cavity (including the encapsulated diamond particles 100).

In additional embodiments, particles of metal matrix material may be mixed with the encapsulated diamond particles 100 and any other hard particles within the mold cavity. The mold may then be placed in a furnace to melt the metal matrix material, and the molten matrix material may locally fill and infiltrate the spaces between particles in the powder bed.

As the molten materials may be susceptible to oxidation, the infiltration process may be carried out under vacuum or in an inert atmosphere. In some embodiments, pressure may be applied to the molten metal matrix material 108 to facilitate the infiltration process and to substantially prevent the formation of voids within the bit body 132 being formed.

After the powder comprising the encapsulated diamond particles 100 has been infiltrated with the molten metal matrix material 108 within the mold, the molten metal matrix material 108 may be allowed to cool and solidify around the encapsulated diamond particles 100, thereby forming the particle-matrix composite material 110.

In additional embodiments, the bit body 132, or components of the bit body, such as the crown region 116, blades, and/or posts, may be formed using so-called particle compaction and sintering techniques such as, for example, those disclosed in pending U.S. patent application Ser. No. 11/271,153, filed Nov. 10, 2005, now U.S. Pat. No. 7,802,495, issued Sep. 28, 2010, entitled *Earth-Boring Rotary Drill Bits and Methods of Forming Earth-Boring Rotary Drill Bits*, and pending U.S. patent application Ser. No. 11/272,439, filed Nov. 10, 2005, now U.S. Pat. No. 7,776,256, issued Aug. 17, 2010, entitled *Earth-Boring Rotary Drill Bits and Methods of Manufacturing Earth-Boring Rotary Drill Bits Having Particle-Matrix Composite Bit Bodies*, the entire disclose of each of which application is incorporated herein by this reference. Briefly, a powder mixture may be pressed to form a green bit body or billet, which then may be sintered one or more times to form a bit body 102 having a desired final density. The powder mixture may include a plurality of encapsulated diamond particles 100 as well as a plurality of particles comprising a metal matrix material 108, as previously described herein. In some embodiments, the powder mixture may be free of any additional particles, such as particles of tungsten carbide. Optionally, the powder mixture may further include additives commonly used when pressing powder mixtures such as, for example, organic binders for providing lubrication during pressing and for providing structural strength to the pressed powder component, plasticizers for making the binder more pliable, and lubricants or compaction aids for reducing inter-particle friction. Furthermore, the powder mixture may be milled with the particles of metal matrix material 108 in, for example, a ball milling process, which may result in the encapsulated diamond particles 100 being at least partially coated with metal matrix material 108.

The powder mixture may be pressed (e.g., axially within a mold or die, or substantially isostatically within a mold or container) to form a green bit body. The green bit body may be machined or otherwise shaped to form features such as blades, fluid courses, internal longitudinal bores, cutting element pockets, etc., prior to sintering. In some embodiments, the green bit body (with or without machining) may be partially sintered to form a brown bit body, and the brown bit body may be machined or otherwise shaped to form one or more such features prior to sintering the brown bit body to a desired final density.

The sintering processes may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes may include subliquidus phase sintering. In other words, the sintering processes may be conducted at temperatures proximate to but below the liquidus line of the phase diagram for the matrix material. For example, the sintering processes may be conducted using a number of different methods known to one of ordinary skill in the art, such as the Rapid Omnidirectional Compaction (ROC) process, the CERACON® process, hot isostatic pressing (HIP), or adaptations of such processes.

When the bit body 132 is formed by particle compaction and sintering techniques, the bit body 132 may not include a metal blank 130 and may be secured to the metal shank 124 by, for example, one or more of brazing or welding. Furthermore, in such embodiments, an extension comprising a machinable metal or metal alloy (e.g., a steel alloy) may be secured to the bit body 132 and used to secure the bit body 132 to a shank 124.

In further embodiments, the infiltration particle compaction and sintering techniques may be used to separately form at least one of the crown region 116 of the drill bit 114, blades 118 of the drill bit, and segments or posts 122 of the drill bit, which may then be secured to a bit body 132 in an infiltration process or by, for example, one or more of brazing and welding.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor.

What is claimed is:

1. A component of an earth-boring tool, comprising:
a particle-matrix composite material comprising:
a metal matrix material; and
a plurality of encapsulated diamond particles embedded within the metal matrix material, the encapsulated diamond particles comprising:
a plurality of diamonds; and
one or more layers of encapsulant material surrounding the diamonds of the plurality of diamonds;
wherein the diamonds of the plurality of diamonds comprise less than about 25% by volume of the particle-matrix composite material, the metal matrix material comprises less than about 50% by volume of the particle-matrix composite material, and the one or more layers of encapsulant material at least substantially comprise a remainder of the volume of the particle-matrix composite material.

2. The component of claim 1, wherein the metal matrix material comprises less than about 40% by volume of the particle-matrix composite material.

3. The component of claim 2, wherein the plurality of encapsulated diamond particles have a multi-modal particle size distribution.

4. The component of claim 1, wherein the metal matrix material comprises between about 10% and about 25% by volume of the particle-matrix composite material.

5. The component of claim 1, wherein the one or more layers of encapsulant material have an average total thickness greater than about fifty percent (50%) of an average diameter of the diamonds.

6. The component of claim 5, wherein the average total thickness of the one or more layers of encapsulant material is greater than about one hundred percent (100%) of the average diameter of the diamonds.

7. The component of claim 6, wherein the particle-matrix composite material has a diamond concentration of about 4.4 carats per cubic centimeter ($cm^3$) or less.

8. The component of claim 7, wherein the particle-matrix composite material has a diamond concentration of about 3.5 carats per cubic centimeter ($cm^3$) or more.

9. The component of claim 1, wherein the particle-matrix composite material is at least substantially free of any additional hard particles.

10. The component of claim 1, wherein the one or more layers of encapsulant material comprises a layer of metal carbide material.

11. The component of claim 10, wherein the one or more layers of encapsulant material comprises a layer of sintered metal carbide material.

12. The component of claim 11, wherein the one or more layers of encapsulant material comprises a layer of sintered tungsten carbide.

13. The component of claim 1, wherein the one or more layers of encapsulant material comprises:
a relatively thicker outer layer of encapsulant material; and
a relatively thinner intermediate layer of encapsulant material disposed between each respective diamond of the plurality of diamonds and the relatively thicker outer layer of encapsulant material.

14. The component of claim 13, wherein the relatively thinner intermediate layer of encapsulant material comprises a layer of a metal material, and the relatively thicker outer layer of encapsulant material comprises a layer of a carbide of the metal material.

15. An earth-boring tool for drilling subterranean formations, at least a portion of the earth-boring tool comprising:
a body having a formation-engaging surface and at least one cutting structure, at least a portion of the body comprising the formation-engaging surface comprising a particle-matrix composite material comprising:
a metal matrix material; and
a plurality of encapsulated diamond particles embedded within the metal matrix material, the encapsulated diamond particles comprising:
a plurality of diamonds; and
one or more layers of encapsulant material surrounding the diamonds of the plurality of diamonds;
wherein the diamonds of the plurality of diamonds comprise less than about 25% by volume of the particle-matrix composite material, the metal matrix material comprises less than about 50% by volume of the particle-matrix composite material, and the one or more layers of encapsulant material at least substantially comprise a remainder of the volume of the particle-matrix composite material.

16. The earth-boring tool of claim 15, wherein the metal matrix material comprises less than about 40% by volume of the particle-matrix composite material.

17. The earth-boring tool of claim 16, wherein the metal matrix material comprises between about 10% and about 25% by volume of the particle-matrix composite material.

18. The earth-boring tool of claim 15, wherein the one or more layers of encapsulant material have an average total thickness greater than about fifty percent (50%) of an average diameter of the diamonds.

19. The earth-boring tool of claim 15, wherein the particle-matrix composite material is at least substantially free of any additional hard particles.

20. The earth-boring tool of claim 15, wherein the one or more layers of encapsulant material comprises a layer of metal carbide material.

21. The earth-boring tool of claim 15, wherein the earth-boring tool comprises a diamond impregnated rotary drill bit having a crown region comprising the particle-matrix composite material.

22. The earth-boring tool of claim 15, wherein the earth-boring tool comprises a diamond impregnated rotary drill bit having a crown region comprising at least one post or blade comprising the particle-matrix composite material.

23. A method of forming a component of an earth-boring tool, the method comprising:
encapsulating diamonds having a selected average particle size with one or more layers of encapsulant material to form a plurality of encapsulated diamond particles having a selected average encapsulant thickness;

embedding the plurality of encapsulated diamond particles in a selected volume of metal matrix material to form a volume of particle-matrix composite material; and selecting the average particle size of the diamonds, the average encapsulant thickness of the plurality of encapsulated diamond particles, and the selected volume of metal matrix material to cause the diamonds to comprise less than about 25% of the volume of the particle-matrix composite material, the metal matrix material to comprise less than about 50% of the volume of the particle-matrix composite material, and the one or more layers of encapsulant material to at least substantially comprise a remainder of the volume of the particle-matrix composite material.

24. The method of claim 23, wherein embedding the encapsulated diamond particles in the selected volume of metal matrix material comprises:

melting the metal matrix material;

infiltrating the encapsulated diamond particles with the molten metal matrix material; and cooling and solidifying the molten metal matrix material.

25. The method of claim 23, wherein embedding the encapsulated diamond particles in the selected volume of metal matrix material comprises:

mixing the plurality of encapsulated diamond particles with a plurality of particles comprising the metal matrix material to form a powder mixture;

pressing the powder mixture to form a green body; and sintering the green body to a desired final density.

26. The method of claim 23, wherein encapsulating diamonds having a selected average particle size with one or more layers of encapsulant material comprises encapsulating diamonds having a selected average particle size with one or more layers of metal carbide material.

27. The method of claim 26, wherein encapsulating diamonds having a selected average particle size with one or more layers of metal carbide material comprises encapsulating diamonds having a selected average particle size with one or more layers of sintered tungsten carbide.

28. The method of claim 23, further comprising selecting the average particle size of the diamonds, the average encapsulant thickness of the plurality of encapsulated diamond particles, and the selected volume of metal matrix material to cause the metal matrix material to comprise less than about 40% of the volume of the particle-matrix composite material.

29. The method of claim 23, further comprising selecting the average particle size of the diamonds, the average encapsulant thickness of the plurality of encapsulated diamond particles, and the selected volume of metal matrix material to cause the metal matrix material to comprise between about 10% and about 25% by volume of the particle-matrix composite material.

30. The method of claim 23, further comprising selecting the average encapsulant thickness to be greater than about fifty percent (50%) of the selected average particle size of the diamonds.

31. The method of claim 30, further comprising selecting the average encapsulant thickness to be greater than about one hundred percent (100%) of the selected average particle size of the diamonds.

32. The method of claim 23, further comprising selecting the average particle size of the diamonds, the average encapsulant thickness of the plurality of encapsulated diamond particles, and the selected volume of metal matrix material to cause the particle-matrix composite material to comprise a diamond concentration of about 4.4 carats of diamond per cubic centimeter ($cm^3$) or less.

33. The method of claim 23, further comprising selecting the average particle size of the diamonds, the average encapsulant thickness of the plurality of encapsulated diamond particles, and the selected volume of metal matrix material to cause the particle-matrix composite material to comprise a diamond concentration of about 3.5 carats of diamond per cubic centimeter ($cm^3$) or more.

* * * * *